United States Patent [19]

Davies

[11] Patent Number: 4,970,745

[45] Date of Patent: Nov. 20, 1990

[54] OPERATING ON SIDE WALL PORTIONS OF A LASTED SHOE

[75] Inventor: John Davies, Syston, England

[73] Assignee: British United Shoe Machinery Ltd., Leicester, United Kingdom

[21] Appl. No.: 377,234

[22] Filed: Jul. 7, 1989

[30] Foreign Application Priority Data

Jan. 25, 1989 [GB] United Kingdom ..... 8901557

[51] Int. Cl.[5] ..... A43D 95/00; A43D 95/16

[52] U.S. Cl. ..... 12/77; 69/6.5; 12/14.2

[58] Field of Search ..... 12/14.2, 14.3, 77, 70, 12/78, 123, 125, 126; 69/6.5

[56] References Cited

U.S. PATENT DOCUMENTS

| | | | |
|---|---|---|---|
| 3,843,985 | 10/1974 | Leonhardt | 12/77 |
| 4,000,535 | 1/1977 | Barton | 12/126 |
| 4,090,378 | 5/1978 | Sommer | 69/6.5 |
| 4,331,011 | 5/1982 | Elliott et al. | 69/6.5 |
| 4,691,398 | 9/1987 | Kadogawa | 12/77 |

FOREIGN PATENT DOCUMENTS

| | | | |
|---|---|---|---|
| 2077090 | 12/1981 | United Kingdom | 12/123 |

*Primary Examiner*—Steven N. Meyers

[57] ABSTRACT

A shoe support (18) for use in a machine for operating progressively onside wall portions of a lasted shoe upper comprises a last pin (722) and a toe support (792) both of which are movable heightwise to bring a shoe supported thereby to a heel seat height datum and toe end height datum as determined respectively by a hold-down (450) and toe abutment (806). Heel end centralizing means (390) and toe end centralizing means (822) are also provided. When the shoe has been properly located the last pin is urged to pivot toewardly thus to cause the last pin to "bind" on the last pin hole formed in the last and, by the counter-force supplied by the toe support (792) the shoe is thus securely clamped on the last pin and toe support, such that as the side wall roughing tool (250) is caused to progress around the side wall portions of the shoe, the toe abutment 806 can be moved to an out-of-the-way position, as the tool approaches the toe end of the shoe, and similarly the holddown and heel end centralizing assembly (780) can be bodily retracted to an out-of-the-way position as the tool approaches the heel end of the shoe. Preferably before the retraction of said assembly (780) the toe abutment (860) is restored to its operative position.

17 Claims, 3 Drawing Sheets

OPERATING ON SIDE WALL PORTIONS OF A LASTED SHOE

BACKGROUND OF THE INVENTION

This invention is concerned with shoe supports for use in a machine for operating on side wall portions of a lasted shoe upper and with machines for operating progressively along side wall portions of a lasted shoe upper.

It will be appreciated that, in a case of operating upon side wall portions of a lasted shoe upper, it is necessary to ensure that the shoe the side wall portions of which are to be operated upon is held in such a manner that the side wall portions are left exposed and no portion of the shoe support will prevent access to the side wall portions by the operating tool.

One shoe support, which is described as for use in a machine for roughing marginal portions of shoe bottoms, is disclosed in GB-A No. 1431127, which shoe support comprises a last pin for supporting, bottom uppermost, a shoe last on which a lasted shoe upper is carried, a toe support for supporting the toe end of a lasted shoe supported by the last pin, and means for urging the toe support upwardly, the arrangement being such that in loading a shoe on the shoe support the last is first placed on the last pin, whereafter relative movement, in a direction lengthwise of the shoe bottom, is effected between the last pin and the toe support, which movement is terminated when the toe is engaged by an abutment associated with the toe support, whereupon the toe support is raised into engagement with the toe end of the shoe, and by such engagement, urges the shoe to tilt about the last pin until the last pin engages the periphery of the last pin hole formed in the last, thereby locking the shoe in position in the shoe support. In this way, it will be appreciated, the shoe is thus held in position merely by the counter-action of the last pin and the toe support.

In the particular machine described in the aforementioned specification the heightwise position of the tool in relation to the shoe is determined by the engagement with the shoe bottom of a stop associated with the tool; in the particular case the stop is in the form of a fork the "prongs" of which are disposed at opposite sides of the tool. In other machines (see e.g. EP-A No. 0043645), however, the heightwise position of the tool relative to the shoe bottom is determined under computer control, to which end it is of course necessary to maintain certain portions of the shoe bottom, e.g. the heel seat and the toe end each at known height datum. In the case of the aforementioned shoe support, clearly the height of the toe end of the shoe will depend essentially upon the amount of heightwise movement which has to be effected to achieve the binding effect of the last pin hole on the last pin, so that the heightwise position of the toe end of the shoe cannot be predetermined. Moreover, the heightwise position of the heel seat of the shoe will, albeit to a lesser degree, also be dependent upon the amount of such heightwise movement of the toe end of the shoe.

OBJECT OF THE INVENTION

It is thus the object of the present invention to provide an improved shoe support in which a lasted shoe can be supported without components of the shoe support impeding the access to side wall portions of the shoe to be roughed, but wherein the shoe is located in known height datum positions at the heel seat and toe end thereof.

SUMMARY OF THE INVENTION

The invention thus provides, in one of its several aspects, a shoe support for use in a machine for operating on side wall portions of a lasted shoe upper, comprising a last pin for supporting, bottom uppermost, a shoe last on which a lasted shoe upper is carried, a holddown mounted for movement into and out of an operative position in which it is disposed in opposed relationship with the last pin, first motor means for bringing the holddown and the heel seat of a lasted shoe upper supported by the last pin into engagement with one another and for positioning, by such engagement, the heel seat at a heel seat height datum as determined by the holddown when in its operative position, a toe support for supporting the toe end of a lasted shoe supported by the last pin, a toe holddown mounted for movement into and out of an operative position in which it is disposed above the toe end of a lasted shoe supported by the last pin, and second motor means for bringing the toe holddown and the toe end of such lasted shoe into engagement with one another and for positioning, by such engagement, the toe end of the shoe at a toe height datum as determined by the toe holddown when in its operative position, wherein the last pin is mounted on a support for pivotal movement relative to said support about an axis extending transversely of the bottom of a lasted shoe supported by the last pin and toe support, and third motor means is provided, operable while the last pin and toe support are maintained at their respective height datum positions for urging the last pin to pivot about its axis in a direction towards the toe support.

It will thus be appreciated that, in using the shoe support in accordance with the present invention, while the securing of the shoe last in position relies upon binding the last pin hole on the last pin, nevertheless during the securing of the shoe last as aforesaid the bottom thereof is maintained at the height datum positions so that when the shoe is finally secured the shoe bottom remains at said datum positions.

The shoe support in accordance with the invention preferably also comprises last pin locking means for locking the last pin against heightwise movement, said means being operable after the shoe supported by the last pin has been brought with its heel seat to the heel seat height datum. Moreover, in the shoe support conveniently the last pin support is mounted for movement in a direction extending transversely of the bottom of a shoe supported by the last pin and toe support and heel end centralising means is provided for centralising the heel end of the shoe supported by the last pin by engagement with opposite sides thereof, said means being operable after the operation of the first motor means to bring the heel seat of the shoe to the heel seat height datum. More particularly, the heel end centralising means is preferably actuated prior to the last pin locking means, and said latter means serves also to lock the last pin support, with the shoe supported on the last pin in a centralised condition, against movement in said direction extending transversely of the shoe bottom.

Conveniently the shoe support in accordance with the invention also comprises toe support locking means for locking the toe support against heightwise movement, said means being operable after the operation of the second motor means to position the toe end of the shoe at the toe height datum. Thus, the toe support may be locked in its heightwise position prior to the pivoting movement of the last pin being effected. Preferably, however, the second motor means remains operable to hold the toe end of the shoe positioned at the toe height datum during the operation of the third, motor means to urge the last pin to pivot as aforesaid and the toe support locking means is operable after the operation of the third motor means to urge the last pin to pivot as aforesaid.

In a preferred embodiment of shoe support in accordance with the invention, toe end centralising means is provided for centralising the toe end of the shoe when supported by the toe support by engagement with opposite sides thereof; such centralising means, furthermore, would conveniently be operated after the operation of the first motor means.

In order to facilitate the loading of a lasted shoe in the shoe support in accordance with the invention, preferably the last pin support is mounted for movement in a direction extending lengthwise of a shoe support by the shoe support and is resiliently urged towards the toe support, means being provided for moving the toe support and toe holddown together heelwardly in response to the presence of the toe end of a shoe in contact with the toe holddown, and furthermore a heel abutment being provided which is engaged by the heel end of the shoe as a result of such heelward movement of the toe support and toe holddown, such engagement of the heel abutment serving to terminate the heelward movement of the toe support and toe holddown and to actuate the first and second motor means. Conveniently, moreover, engagement of the heel abutment as aforesaid also causes the toe centralising means to be operated.

The shoe support in accordance with the invention is especially, but not exclusively, intended for use in a machine for operating progressively along side wall portions of a lasted shoe upper, said machine further comprising a tool support arrangement by which a holder for a rotary radial tool is supported, drive means for effecting relative movement between the shoe support and the tool support arrangement in directions extending lengthwise, widthwise and heightwise of the bottom of a shoe support by the shoe support whereby a tool supported by the holder can be caused to operate progressively along the side wall portions of a shoe supported by the shoe support, and means for retracting the holddown and toe holddown of the shoe support from their respective operative positions so as to ensure that said holddown and toe holddown will not interfere with the passage of the tool in operating progressively along the side wall portions of the lasted shoe upper.

More particularly, where the shoe support comprises toe support locking means as above described, conveniently the retracting means is operable to retract the toe holddown as aforesaid after the operation of the toe support locking means. Although the toe holddown could be retracted at any time after such locking, it has been found preferable to cause the toe holddown to be retracted in timed relation with the progressive operation of the tool. Moreover, preferably, following the passage of the tool past the toe end of the shoe and prior to retraction of the holddown, the toe holddown is returned to its operative position.

Similarly, where last pin locking means is provided, conveniently the retracting means is operable to retract the holddown as aforesaid after the operation of the last pin locking means, and moreover, where heel end centralising means is provided, said means is caused to release the heel end of the shoe and be retracted together with the holddown to an out-of-the-way position. As in the case of the toe holddown, furthermore, conveniently the retraction of the holddown takes place in timed relation with the progressive operation of the tool. For greater security, furthermore, preferably the toe holddown is returned to its operative posiion prior to the retraction of the holddown. In this way, while the toe holddown is out of its operative position the shoe is held not only by the inter-action of the toe support and last pin but also by the action of the holddown acting at the heel seat, while, when the holddown is retracted from the heel seat, the toe holddown serves to hold the shoe in position, in cooperation with the securement by the inter-action of the last pin and toe support.

BRIEF DESCRIPTION OF THE DRAWINGS

There now follows a detailed description, to be read with reference to the accompanying drawings, of one shoe support in accordance with the invention and of a machine incorporating such a shoe support. It will of course be appreciated that this shoe support and this machine have been selected for description merely by way of exemplification of the invention and not by way of limitation thereof.

In the accompanying drawings.

DESCRIPTION OF THE PREFERRED EMBODIMENT

Figure 1:
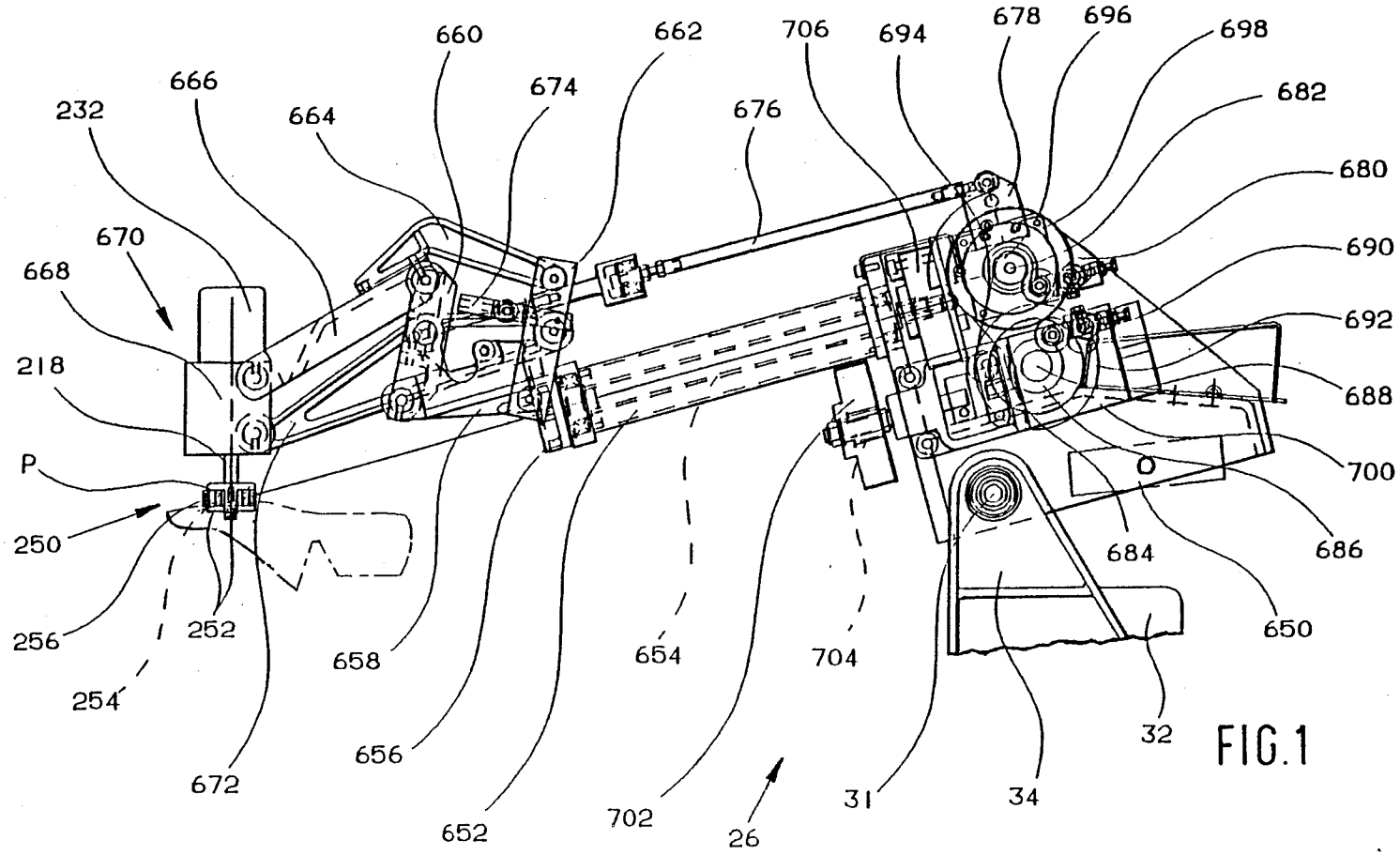
FIG. 1 is a view in side elevation of a tool support arrangement of the machine in accordance with the invention, with a tool supported thereby.

The machine now to be described is generally similar, except as hereinafter described, to the machine described in EP-A No. 0091321, itself a modification of the apparatus described in EP-A No. 0043645, which machine is for performing a roughing operation progressively along marginal portions of a shoe bottom. It will however be appreciated that the machine described hereinafter is a machine for performing a roughing operation progressively along side wall portions of a shoe. Reliance is thus placed upon the disclosure of the aforementioned EP specification and in particular, where like parts are incorporated in the two machines but are not shown in the drawings of the present specification, the reference numerals from the earlier specification are used, but are placed in brackets to indicate that the parts are not shown in the present drawings.

The machine in accordance with the invention thus comprises a base (10) supporting, by a bracket (12), a pivot shaft 14 about which a support 16 for a shoe support 18' can pivot. The shoe support, details of which are set out hereinafter, is arranged to support a shoe S bottom uppermost, with the toe end thereof facing towards the front of the machine, i.e. towards the operator.

At its rear, the base (10) supports a support column structure (22) carrying a casting (24) on which is supported, for pivotal movement about a vertical axis, a support casting 34 having two upstanding lugs 32 between which tool supporting means generally designated 26' is supported for pivotal movement about a horizontal axis 31. The machine further comprises a first stepping motor (144) mounted on the base (10) and effective to cause pivotal movement of the shoe support 18' to take place about the horizontal axis provided by the shaft 14 (X-axis movement). Similarly, a second stepping motor (84) is provided, carried by the casting (24) and effective to cause pivotal movement of the support casting 34 about its vertical axis (Y-axis movement). In addition, a third stepping motor (122—described in EP-A No. 0043645) is supported by the support casting 34, rearwardly of its vertical pivot, to cause it, and thus the tool supporting means 26' supported thereby, to pivot about its horizontal axis 31 (Z-axis movement). It will be appreciated that the X-, Y- and Z-axes represent three coordinate axes along which a tool supported by the tool supporting means 26' can move.

Further details of the construction by which movement along the three axes can take place can be found in EP-A No. 0091321 and also in No. 0043645.

The tool supporting means 26' of the machine in accordance with the invention comprises a housing 650 mounted for pivotal movement about said horizontal axis 31. From a forward face of the housing projects a hollow tubular arm 652 within which is accommodated, for rotational movement therein, a support rod 654. At the forward end of said rod is a plate 656 supporting two forwardly projecting arms 658, which are spaced apart widthwise of the machine and on each of which is mounted, for pivotal movement, a pair of links 660, 662, upper ends of which pivotally support a plate 664. The links 660, 662, together with the plate 664 and arms 658, thus comprise a first parallel linkage arrangement of the tool supporting means.

Fixedly secured to a forward end of the plate 664, and projecting forwardly therefrom, is a further plate 666, in a forward, bifurcated, end of which is pivotally mounted a block 668 forming part of a tool holder generally designated 670. Also secured to the tool holder, at the left-hand side thereof, is a further link 672 which is in turn pivotally connected to each of the left-hand links 660, 662. The links 660, 662, tool holder 670, link 672 and composite plate 664, 666 thus constitute a second parallel linkage of the tool supporting means. The various pivots are so arranged in relation to one another that the tool holder is caused to pivot about an axis (a virtual centre) which passes through a point P, through which point also passes the axis of the support rod 654. As will be described hereinafter, furthermore, when a tool is supported in the tool holder 670, the axis of rotation thereof also passes through said point P. The point P represents a height datum of the machine in a desired relationship with which the bottom of a shoe supported by the shoe support 18' can be positioned by means of a holddown member 450 and toe support means 470' of said support. Furthermore, the point P lies vertically above the axis 14 of the shoe support 18'.

For effecting such pivotal, or tilting, movement of the tool holder 670 about the transverse axis, the links 662 carry therebetween a block 674 to which is pivotally connected a forward end of a push-rod 676, the rearward end of which is similarly pivotally connected to a block 678 which is mounted on a pulley 680 freely rotatable about a drive shaft 682. The pulley 680 is caused to rotate about said shaft by a timing belt 684 entrained around a second pulley 688, a tensioning pulley 690 being provided for maintaining the tension in the belt. Also mounted on the shaft 688 is a third pulley 692 around which is entrained a second timing belt 694 meshing with a fourth, drive, pulley 696 secured on the drive shaft 682. The shaft 682 is driven by a stepping motor 698.

For effecting rotational movement of the support rod 654, a similar drive arrangement is provided comprising a stepping motor 700 acting through pulleys 702, 704, 706 (the fourth not being shown) and timing belts (not shown), the pulley 706 being fixedly mounted on the support rod 654.

Figure 2:
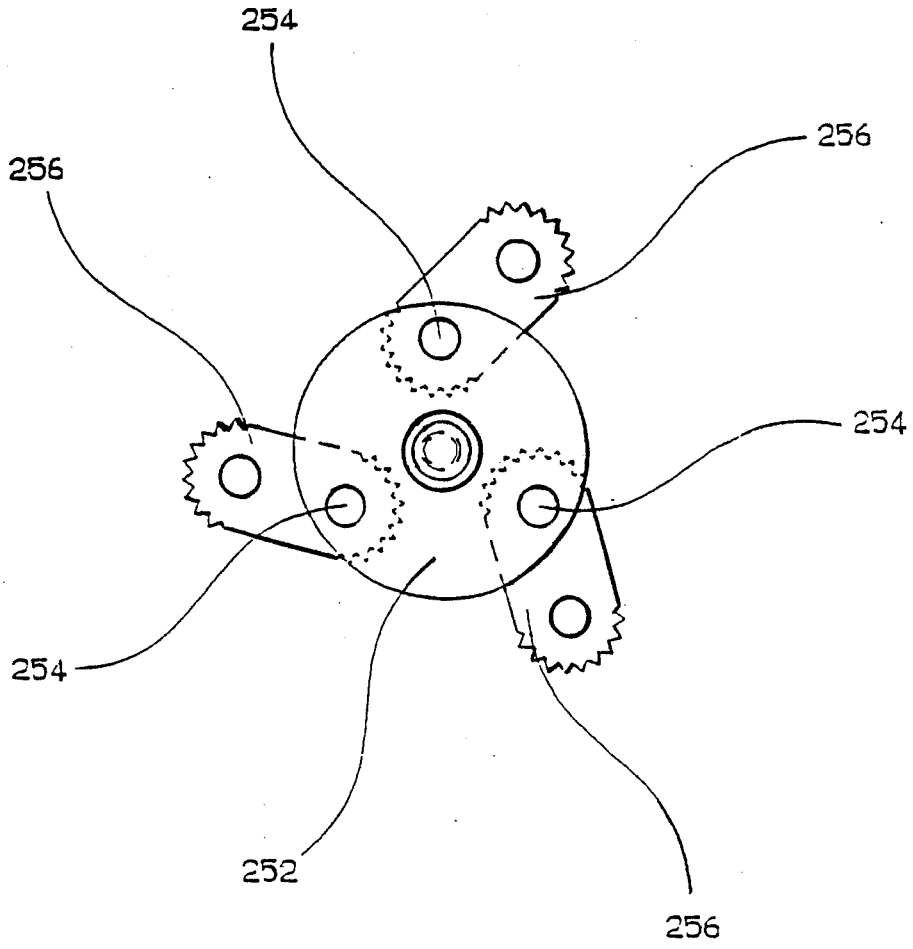
FIG. 2 is a view of a roughing tool having flail-like roughing devices.

The tool holder 670 is arranged to support a tool-supporting shaft 218 which is caused to rotate by means of a reversible motor 232, itself mounted on the tool holder 670 and being operatively connected to the shaft 218 via a belt-and-pulley connection (not shown). The lower end of the shaft 218 is adapted to receive a suitable roughing tool generally designated 250. Whereas this tool may be any suitable roughing tool, e.g. a radial wire brush or an abrasive-covered wheel, in the embodiment shown in the drawings, the tool comprises two discs 252 spaced apart from one another by three pins 254, each pin supporting a plurality of thin plate-like roughing elements 256. As is clearly seen in FIG. 2, each plate-like element 256 is loosely mounted on its pin for pivotal movement thereon, is generally oval in shape and comprises, at each semi-circular end a plurality of teeth, the teeth providing a roughing surface of the tool. When the tool is caused to rotate, the various plate-like elements are urged outwardly about the pins 252, by virtue of centrifugal force, in a flail-like action. It will of course be appreciated that, since a plurality of such elements is provided on each pin, the amount to which each element is thrown outwardly by centrifugal force will be determined to some degree by the contour of the shoe which is engaged thereby, each set of such elements thus together forming a shape, upon engagement with the shoe, complementary to the contour of the portion of the side wall of the shoe being roughed thereby. It will also be appreciated that, using a tool as described above, any irregularites in the side wall portion of the shoe being operated upon may be compensated for by the action of the elements 256.

Figure 3:
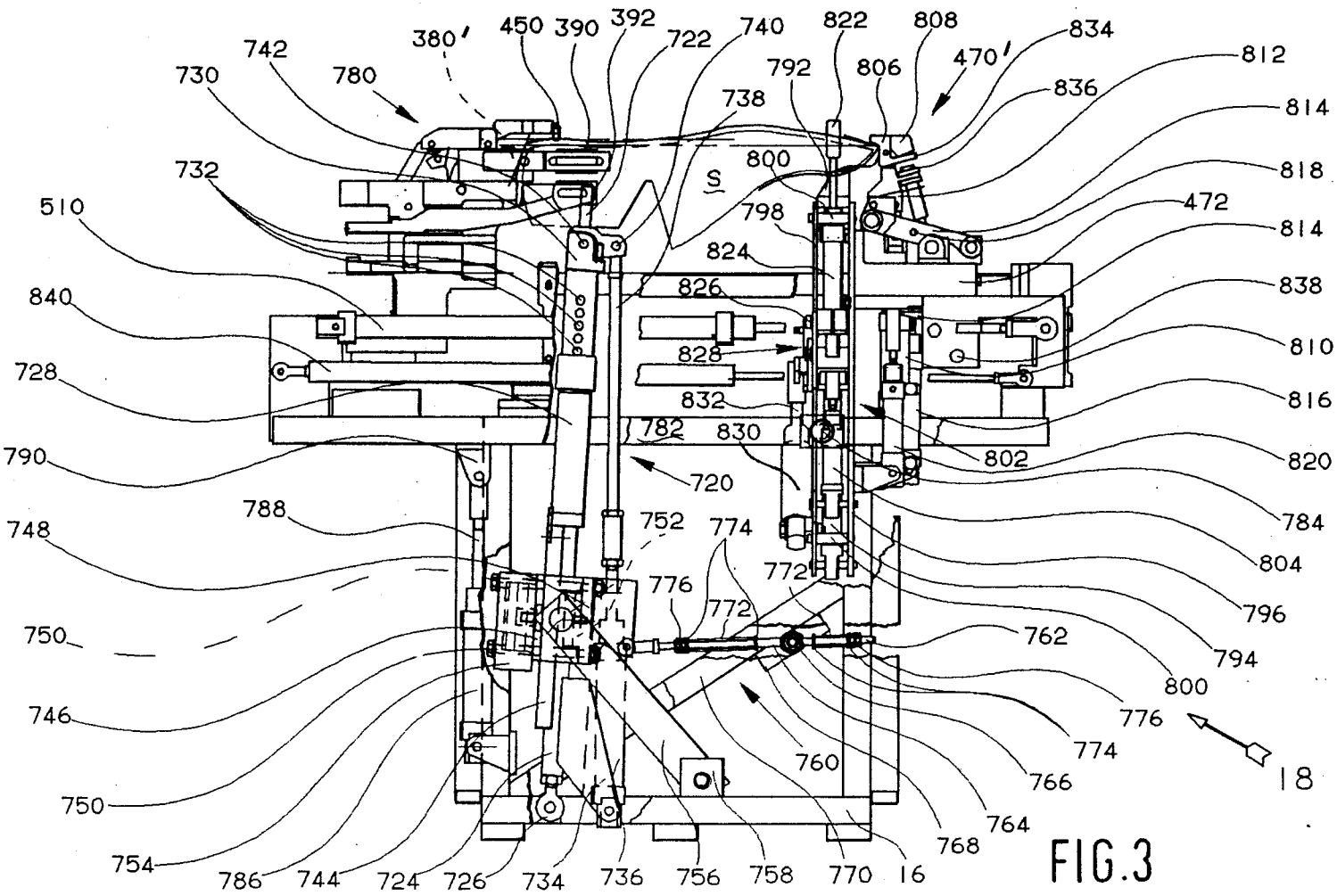
FIG. 3 is a view in side elevation of a shoe support in accordance with the invention.

Referring now to FIG. 3, the shoe support 18' in accordance with the invention comprises a support 720 for a last pin 722, said support itself comprising a rod 724, mounted at its lower end, by a spherical mounting 726, on the support 16 of the shoe support and extending upwardly, together with a sleeve 728 which is slidable on the rod 726 and carries at its upper end a mounting 730 for the last pin 722. The position of the sleeve 728 relative to the rod 724 can be set by selectively inserting a pin (not shown) in one of a number of apertures 732, the pin being arranged to rest in engagement with the top end of the rod 724.

For effecting heightwise movement of the support 720 a forked member 734 is secured towards the lower end of the rod 724 and in turn supports, between its forks, a piston-and-cylinder arrangement 736, the piston rod 738 of which extends upwardly and is pivotally connected at its upper end to a bifurcated projection 740 formed on the body of the last pin 722. The last pin 722 is mounted in its holder 730 for limited pivotal movement about an axis 742 extending widthwise of the bottom of a shoe supported by the last pin in the shoe support.

At its lower end the sleeve 728 carries a semi-cylindrical member 744 which extends around the lower end of the rod 724. The member 744 and rod 724 pass between two clamp plates 746, 748 which are held spaced apart on four rods 750 (two only shown in FIG. 3). The plate 748 also supports, for limited sliding movement in a direction extending transversely of the bottom of a shoe supported by the last pin, a further semi-cylindrical member 752 which fits about the opposite side of the rod 724 from that contacted by the member 744. For moving the clamp plates towards one another a short-stroke piston-and-cylinder arrangement 754 is provided, whereby the members 744, 752 are urged against the rod to clamp it in any position to which it has been moved, both heightwise and widthwise, in the loading of a shoe, as will be explained hereinafter.

The assembly of clamp plates 746, 748 and the piston-and-cylinder arrangement 754 is pivotally supported by two links 756 which are carried on blocks 758 in turn carried on the support 16 for the shoe support. Said assembly can thus pivot to a limited degree, in a direction extending lengthwise of the bottom of a shoe supported by the last pin, as the loading of the shoe is taking place.

For establishing an initial position for the last pin 722, a balancing arrangement generally designated 760 is provided, comprising a rod 762 pivotally mounted at one end on the cylinder 736 and having a central portion 764 of enlarged diameter accommodated in a block 766 itself carried in blocks 768 secured to strut members 770 forming part of the support 16. At each side of said portions 764 the rod 762 carries a compression spring 772, washers 774 being provided at opposite ends of the springs for abutment against surfaces provided either by the portion 764 or by lock nut 776 threadedly secured to the rod. The effect of the springs 772 is thus to centralise the rod in relation to the block 766, thus to establish the initial position of the last pin 722, while nevertheless allowing the last pin support to move in any direction on the spherical mounting 726.

The shoe support in accordance with the invention also comprises a combined holddown and heel end centralising assembly generally designated 780. This assembly is mounted on a frame 782 which is supported for pivotal movement about an axis 784 on the support 16. For effecting such pivotal movement two piston-and-cylinder arrangements 786 (one only shown in FIG. 3) are carried by the support 16 and the piston rod 788 of each such arrangement is pivotally connected with a lug 790 formed on the underside of the frame 782.

The assembly 780 is generally similar, except as hereinafter described to the holddown and heel end centralising means of the shoe support described in GB-A No. 2077090, and full details of the assembly will therefore not be described in the present specification. In general terms, the assembly 780 thus comprises a holddown 450 which is movable into and out of an operative position in which it lies in opposed relationship with and above the last pin 722 and provides a height datum for the heel seat of a shoe which is placed upon the last pin and urged by the action of piston-and-cylinder arrangement 736 into engagement therewith. The movement of the holddown into and out of its operative position is effected by means of a piston-and-cylinder arrangement (not shown, but designated 460 in the aforementioned specification). Furthermore, the arrangement 736 constitutes means for bringing the heel seat of a shoe and the holddown 450 into engagement at the heel seat height datum.

The heel end centralising means comprises first and second sets of clamps 390, 392 which respectively engage the heel end of a shoe in the region of the feather line and in the region of the top line thereof; again, details of these clamps are to be found in GB-A No. 2077090. The first set of clamps 390 are movable towards one another each through the same distance to engage the shoe in a region which is generally symmetrical about the toe-to-heel centre line of the shoe and thus effectively centralise the heel end of the shoe about the centre line of the shoe support. The second set of clamps 392 engage the shoe in a relatively asymmetrical region thereof and can move towards one another through different distances to accommodate to the asymmetry, serving primarily therefore as clamps to hold the shoe in position as determined by the first set of clamps 390. The two sets of clamps are each actuated by a piston-and-cylinder arrangement (not shown, but designated respectively 406 and 438 in the aforementioned specification).

The shoe support also comprises means for determining whether the shoe supported thereby is a left or a right, said means comprising a sensing device (not shown, but designated 610 in the aforementioned specification) which is of the inductance type and senses the position of the second set of clamps 392 in relation to a centre line of the support and thereby determines whether the shoe is a left or a right.

The assembly 780 further comprises a heel abutment 380' in the form of a plate against which the backseam region of a shoe placed on the last pin can be urged thus to determine the lengthwise position of the shoe in the shoe support 18. The plate 380' is resiliently urged toewardly through a short distance and has associated therewith a proximity switch (not shown) which is actuated when the plate 380' is caused to retract against the influence of the resilient means. Such actuation of the proximity switch causes a signal to be supplied to which reference will be made hereinafter. For supporting the toe end portion of the shoe the shoe support 18' further comprises toe support means generally designated 470', which comprises a support casting 472 slidably mounted on two rods 356 extending lengthwise of the shoe support. For effecting such movement a piston-and-cylinder arrangement 510 is provided a piston rod of which is connected with the toe support means 470' and the cylinder of which is supported by a support portion forming part of the holddown and heel end centralising assembly 780. A further piston-and-cylinder arrangment 820 is provided for operating a bar lock arrangement (not shown) by which the toe support means 470' is held locked on the slide rods 356 after a shoe has been loaded and positioned in the shoe support.

The toe support means 470' comprises a toe support or toe pad 792 on which the toe end of a shoe supported by the last pin 722 can be supported, said toe pad being supported at the upper end of a column 793 itself carried by a piston rod (not shown) of a piston-and-cylinder arrangement 794. The arrangement 794 is supported by a pin extending between a support plate 796 and a front plate 798 secured thereto by spacers 800. The support plate 796 is carried between, and extends heightwise of, the two blocks 472. For locking the toe pad in its heightwise adjusted position, a bar lock arrangement generally designated 802 is provided which is actuated by a piston-and-cylinder arrangement 804, itself also supported by a pin between the support plate and front plate.

The toe support means 470' also comprises a toe hold-down or toe abutment 806 which is pivotally mounted on a support 808, itself mounted for pivotal movement, under the action of a piston-and-cylinder arrangement 810, on a block 812. The block 812 is itself supported by parallel links 814, whereby heightwise movement of the toe abutment 806 can be effected to move it from an operative position, in which it provides a height datum for the toe end of a shoe, to an out-of-the-way position, in which it will not interfere with the access by a roughing tool to side wall portions of the lasted shoe upper. For effecting such heightwise movement of the abutment a piston-and-cylinder arrangement 816 is provided a piston rod of which is connected to one of the links 814 by pivot pin 818. The piston-and-cylinder arrangement 816 is secured at its lower end on a lug on the support plate 796.

The toe support means 470' has associated therewith toe end centralising means comprising two upstanding centralising fingers 822 each carried by a piston-and-cylinder arrangement 824, itself mounted for pivotal movement about an axis extending lengthwise of the bottom of a shoe support by the shoe support whereby the centralising fingers are movable towards and away from one another as well as being movable heightwise under the action of said piston-and-cylinder arrangement 824. The cylinders are pivoted on pivot pins 826 which are interconnected by a linkage generally designated 828 whereby to effect equal but opposite rotational movement of the pivot pins and thus equal but opposite pivotal movement of the centralising fingers. For effecting such movement, furthermore, a piston-and-cylinder arrangement 830 is provided a piston rod 832 of which is connected to said linkage, said arrangement being mounted on the front plate 798.

In the operation of the machine in accordance with the invention a shoe is loaded into the shoe support 18, by placing the last with its last pin hole placed on the last pin 722. The operator then draws the shoe, together with the support 720, toewardly until the shoe abuts the toe abutment 806, causing it to pivot on its support 808. Such pivotal movement causes a rearwardly extending projection 834 on said abutment to be moved relative to a proximity switch 836 on the support 808, thereby signalling the presence of the toe end of the shoe. It will be realised that at this time the toe abutment is held in its raised position under the action of piston-and-cylinder 816 and the support is pivoted (anti-clockwise during FIG. 3) to bring the toe abutment into its operative position in which it provides a heightwise datum for the toe end of the shoe; also at this time the toe pad 792 is in its retracted position. In response to the signal from the proximity switch 836 piston-and-cylinder arrangement 510 is actuated to move the blocks 472 along the rods 356 thus to move the shoe bodily together with the toe support means 470' towards the heel abutment 480'. Upon engagement of the heel end of the shoe with the heel abutment, the proximity switch associated with said abutment is actuated by the retraction of the heel abutment, thereby creating a further signal which terminates the operation of piston-and-cylinder arrangement 510 thus to bring the toe support means 470' to rest with the shoe now held by the various instrumentalities referred to. In addition piston-and-cylinder arrangement 820 is operated to cause the toe support means 470' to be locked in this position. The shoe support also comprises a linear potentiometer 840 which is mounted at one end on the support portion of the holddown and heel end centralising assembly 780 which supports also the piston-and-cylinder arrangement 510, and the slide of which is connected to the toe support means 470'. In this way, the length of the shoe which is to be operated upon is measured, as a function of the amount of movement of the toe support means 470' towards the hold-down and heel end centralising assembly 480.

When the machine is in its rest condition, the hold-down 450 providing the height datum for the heel seat region of the shoe is in its operative position and the last pin is retracted. When the signal is generated by the heel abutment, the last pin is raised under the action of piston-and-cylinder arrangement 734 to bring the heel seat region of the shoe into engagement with the hold-down 450 and also the toe pad 792 is raised under the action of piston-and-cylinder arrangement 794, to bring the toe end of the shoe into the correct heightwise position in relation to the toe abutment 806. It will be appreciated that, because the last pin 722 cannot pivot anti-clockwise (viewing FIG. 3) beyond a generally vertical position, the action of piston-and-cylinder arrangement 734 acting thereon will be to cause the last pin support to be raised. At the same time, the heel clamp arrangements 390, 392 and also the centralising fingers 822 are operated whereby to centralise both the heel end of the shoe and the toe end thereof along the centre line of the shoe support, the clamps 390 also serving the determine whether the shoe is a left or a right. The heightwise position of both the last pin and the toe pad and also the widthwise position of the last pin are thus established according to the size, style and "hand" of the shoe and thereupon the locking arrangement for the last pin support 720 and also the bar lock arrangement 802 are operated upon actuation respectively of piston-and-cylinder arrangements 754 and 804. When the last pin has been thus locked in position, furthermore, the piston-and-cylinder arrangement 736 is caused to move in an opposite direction whereby the last pin 722 is caused to be urged to pivot relative to its support 720 toewardly in order to ensure that the last pin binds on the last pin hole, thereby securing the lasted shoe between the last pin and the toe pad. (It will thus be appreciated that piston-and-cylinder arrangement 736 has the dual function of raising the last pin and also urging it to pivot; by reason of these separate functions this arrangement constitutes in the preferred embodiment both first and third motor means of the shoe support.

At this stage the lasted shoe is thus corrected clamped in the shoe support 18 and is ready for the initiation of a side wall roughing operation. Upon such initiation firstly the centralising fingers 822 are moved outwardly and retracted by the actuation respectively of piston-and-cylinder arrangements 830 and 824. The roughing tool is then brought from its rest, retracted, position to an operative position in which it engages the side wall portion of the shoe in the region of the breast line of the inside waist thereof; at this stage the shoe is still held not only by the last pin and toe pad as aforesaid, but also by the toe abutment 806 and the clamps 390, 392 and hold-down 450. As the tool approaches the toe end of the shoe, a signal is generated to cause the toe abutment 806 to be pivoted under the action of piston-and-cylinder arrangement 810 and also to be retracted under the action of piston-and-cylinder arrangement 816 acting through the parallel linkage 814. A proximity switch 838 is provided whereby in response to such retraction a signal is generated indicating that such retraction has taken place; in the event of no such signal being generated, the advancing movement of the tool towards the toe end of the shoe will be arrested. After the passage of the tool round the toe end of the shoe, the toe abutment is returned to its operative position. In this return movement, furthermore, the proximity switch 838 ensures that the heightwise movement under the action of piston-and-cylinder arrangement 826 takes place before the swinging movement of the support 808 under the action of piston-and-cylinder arrangement 810. In this way it is ensured that no collision can take place between the toe abutment 806 and the toe end of the shoe.

Similarly, as the tool approaches the heel end of the shoe, the clamps 390, 392 are caused to release the heel end of the shoe, the holddown is retracted out of its operative position and the assembly 780 is then moved bodily about the axis 784 to an out-of-the-way position under the action of piston-and-cylinder arrangements 786. The tool can then progressively operate around the heel end of the shoe and back to its starting position at the breast line of the shoe, whereafter the tool is moved out of operative engagement with the shoe and returns to its initial position.

The shoe support then returns to its loading/unloading position and the toe support means 470' is moved in a direction away from the heel abutment under the action of piston-and-cylinder arrangement 510 thus to release the shoe.

As already mentioned, the machine has both an "operating" mode and a "teaching" mode. For the purpose of the latter, operator-actuatable means in the form of a cursor arrangement (not shown) or a joystick control (also not shown) is provided whereby the path of movement of the tool can be determined; the particular path determination procedure is described in detail in e.g U.S. Pat. No. 4541054. In addition, further operator-actuatable means (again not shown) is provided whereby under operator control the angular disposition of the tool holder 670 about the point P can be set, for each digitised point about the axis of the support rod 654 (usually referred to as the "camber" setting) and also about the virtual centre as determined by the two parallel linkage arrangements referred to above (usually referred to as the "tilt" control). In the "operating" mode, thereafter, not only does the tool follow the path as digitised, but in addition the angular disposition of the tool about said two axes is progressively varied according to the settings made during the "teaching" mode.

It will thus be appreciated that, using the machine as described above, it is possible, in addition to controlling the path of movement of the shoe along the X-, Y- and Z-axes, also to set the angular disposition of the tool both widthwise and lengthwise of the shoe bottom. It will further be appreciated that in this way side wall portions of shoes having steeply inclined waist portions and significantly shaped lateral contours can readily be operated upon, while maintaining the axis of rotation of the tool normal or substantially normal to the side wall portion being operated on at any given time.

For the digitising procedure itself and also for controlling the operation of the machine in its operating mode the machine also comprises computer control means. This means comprises a memory in which a number of programed instructions can be stored for different styles of shoe and also in which a number of sub-routines are stored for processing the data relating to the various styles. Thus one such sub-routine serves to determine the path the tool will follow, based upon the digitised points. A further sub-routine is a grading programme which, according to the shoe length, as "measured" by the shoe support 18 is effective correspondingly to vary the distance between successive digitised points along the X-axis and also proportionately to vary the Y-axis movement, such variation of the X-axis movement also serving to vary the incidence of the Z-axis movement and the pivotal movement about the first and second axes ('camber' and 'tilt' movement) of the tool holder 670.

Whereas in the embodiment described above a roughing tool is used for operating on the side wall portions of a shoe, this tool could readily be replaced by an applicator tool for the application of primer or adhesive to such side wall portions. Moreover, whereas in the embodiment hereinbefore described the tool operates progressively along the side wall portions of a shoe, it will be appreciated that the shoe support would also be capable of use in a machine in the operation of which a "one-shot" operation is performed on the shoe.

I claim:

1. Shoe support for use in a machine for operating on side wall portions of a lasted shoe upper, comprising a last pin for supporting, bottom uppermost, a shoe last on which a lasted shoe upper is carried, a holddown mounted for movement into and out of an operative position in which it is disposed in opposed relationship with the last pin, first motor means for bringing the holddown and the heel seat of a lasted shoe upper supported by the last pin into engagement with one another and for positioning, by such engagement, the heel seat at a heel seat height datum as determined by the holddown when in its operative position, a toe support for supporting the toe end of a lasted shoe supported by the last pin, a toe holddown mounted for movement into and out of an operative position in which it is disposed above the toe end of a lasted shoe supported by the last pin, and second motor means for bringing the toe holddown and the toe end of such lasted shoe into engagement with one another and for positioning, by such engagement, the toe end of the shoe at a toe height datum as determined by the toe holddown when in its operative position, wherein the last pin is mounted on a support for pivotal movement relative to said support about an axis extending transversely of the bottom of a lasted shoe supported by the last pin and toe support, and third motor means is provided, operable while the last pin and toe support are maintained at their respective height datum positions, for urging the last pin to pivot about said axis in a direction towards the toe support.

2. Shoe support according to claim 1 wherein last pin locking means is provided for locking the last pin against heightwise movement.

3. Shoe support according to claim 1 wherein the last pin support is mounted for movement in a direction extending transversely of the bottom of a shoe supported by the last pin and toe support, and wherein heel end centralising means is provided for centralising the heel end of the shoe supported by the last pin by engagement with opposite sides thereof, said means being operable after the operation of the first motor means to bring the heel seat of the shoe to the heel seat height datum.

4. Shoe support according to claim 3 wherein last pin locking means is provided for locking the last pin against heightwise movement.

5. Shoe support according to claim 4 wherein the heel end centralising means is actuated prior to the last pin locking means, said latter means serving also to lock the last pin support, with the shoe supported on the last pin in a centralised condition, against movement in said direction extending transversely of the shoe bottom.

6. Shoe support according to claim 1 wherein toe support locking means is provided for locking the toe support against heightwise movement, said means being operable after the operation of the second motor means to position the toe end of the shoe at the toe height datum.

7. Shoe support according to claim 6 wherein toe end centralising means is provided for centralising the toe end of the shoe when supported by the toe support by engagement with opposite sides thereof, said means being operable after the operation of the second motor means and prior to the operation of the toe support locking means.

8. Shoe support according to claim 1 wherein the last pin support is mounted for movement in a direction extending lengthwise of a shoe supported by the shoe support and is resiliently urged towards the toe support, and wherein means is provided for moving the toe support and toe holddown together heelwardly in response to the presence of the toe end of a shoe in contact with the toe holddown, and further wherein a heel abutment is provided which is engaged by the heel end of the shoe as a result of such heelward movement of the toe support and toe holddown, such engagement of the heel abutment serving to terminate the heelward movement of the toe support and toe holddown and to actuate the first and second motor means.

9. A machine for operating progressively along side wall portions of a lasted shoe upper comprising:

a last pin for supporting bottom uppermost a shoe last on which a lasted shoe upper is carried wherein the last pin is mounted on a support for pivotal movement relative to said support about an axis extending transversely of the bottom of a lasted shoe supported by the last pin and toe support;

a holddown mounted for movement into and out of an operative position in which it is disposed in opposed relationship with the last pin;

first motor means for bringing the holddown and the heel seat of a lasted shoe upper supported by the last pin into engagement with one another and for positioning, by such engagement, the heel seat at a heel seat height datum as determined by the holddown when in its operative position;

a toe support for supporting the toe end of a lasted shoe supported by the last pin;

a toe holddown mounted for movement into and out of an operative position in which it is disposed above the toe end of a lasted shoe supported by the last pin;

second motor means for bringing the toe holddown and the toe end of such lasted shoe into engagement with one another and for positioning, by such engagement, the toe end of the shoe at a toe height datum as determined by the toe holddown when in its operative position;

third motor means operable while the last pin and toe support are maintained at their respective height datum positions for urging the last pin to pivot about said axis in a direction towards the shoe support;

a tool support arrangement by which a holder for a rotary radial tool is supported;

drive means for effective relative movement between the shoe support and the tool support arrangement in directions extending lengthwise, widthwise and heightwise of the bottom of the shoe supported by the shoe support whereby a tool supported by the holder can be caused to operate progressively along the side wall portions of a shoe supported by the shoe support; and means for retracting the holddown and the toe holddown of the shoe support from their respective operative positions so as to ensure that said holddown and said toe holddown will not interfere with the passage of the tool in operating progressively along the side wall portions of the lasted shoe upper.

10. Machine according to claim 9 wherein the last pin support is mounted for movement in a direction extending transversely of the bottom of a shoe supported by the last pin and toe support, and wherein heel end centralising means is provided for centralising the heel end of the shoe supported by the last pin by engagement with opposite sides thereof, said means being operable after the heel seat of the shoe has been brought to a heel seat height datum determined by the holddown in its operative position.

11. Machine according to claim 10 wherein last pin locking means is provided for locking the last pin against heightwise movement.

12. Machine according to claim 11 wherein the retracting means is operable to retract the holddown as aforesaid after the operation of the last pin locking means.

13. Machine according to claim 12 wherein the heel end centralising means is caused to release the heel end of the shoe and be retracted together with the holddown to an out-of-the-way position.

14. Machine according to claim 9 wherein the shoe support also comprising toe support locking means for locking the toe support against heightwise movement, and wherein the retracting means is operable to retract the toe holddown as aforesaid after the operation of the toe support locking means.

15. Machine according to claim 14 wherein the toe holddown is retracted in timed relation with the progressive operation of the tool.

16. Machine according to claims 9 wherein, following the passage of the tool past the toe end of the shoe and prior to retraction of the holddown, the toe holddown is returned to its operative position.

17. Machine according to claim 9 wherein the shoe support further comprises toe end centralising means for centralising the toe end of the shoe when supported by the toe support by engagement with opposite sides thereof, said means being operable after the toe end of the shoe supported by the toe support has been brought to a toe height datum determined by the toe holddown in its operative position and prior to the operation of the toe support locking means, and wherein initiation of a cycle of operation is effective to cause retraction of said means to an out-of-the-way position.

* * * * *